US009943455B2

(12) United States Patent
Hagler

(10) Patent No.: US 9,943,455 B2
(45) Date of Patent: Apr. 17, 2018

(54) "P.C. BUBBLE" PROTECTIVE BUBBLE FOR MOBILITY VEHICLE

(71) Applicant: Crescia E. Hagler, St. Paul, MN (US)

(72) Inventor: Crescia E. Hagler, St. Paul, MN (US)

( * ) Notice: Subject to any disclaimer, the term of this patent is extended or adjusted under 35 U.S.C. 154(b) by 18 days.

(21) Appl. No.: 15/082,804

(22) Filed: Mar. 28, 2016

(65) Prior Publication Data

US 2016/0317369 A1 Nov. 3, 2016

Related U.S. Application Data

(60) Provisional application No. 62/179,159, filed on Apr. 30, 2015.

(51) Int. Cl.
*A61G 5/10* (2006.01)

(52) U.S. Cl.
CPC ..... *A61G 5/10* (2013.01)

(58) Field of Classification Search
CPC ..... A61G 5/10
See application file for complete search history.

(56) References Cited

U.S. PATENT DOCUMENTS 4,389,057 A * 6/1983 Richard, Jr. ..... A61G 5/10 135/90
4,754,987 A * 7/1988 Williams ..... A61G 5/00 280/304.1
4,949,740 A * 8/1990 Friday ..... A61G 5/10 135/117
7,690,390 B2 * 4/2010 Hopkins ..... B62J 17/08 135/88.03
7,946,373 B2 * 5/2011 Gibson ..... B62J 17/08 180/206.5
9,795,526 B2 * 10/2017 Davis ..... A61G 5/10
2002/0157693 A1 * 10/2002 Whitmer ..... A45B 11/00 135/16
2004/0103934 A1 * 6/2004 Szumlic ..... A45B 7/005 135/16
2004/0129306 A1 * 7/2004 Jefferson ..... B62B 9/142 135/96
2008/0011345 A1 * 1/2008 Mohns ..... A47C 7/66 135/88.01
2008/0185028 A1 * 8/2008 Ayers ..... A61G 5/10 135/88.13

(Continued)

FOREIGN PATENT DOCUMENTS

DE 3522674 A1 * 2/1987 ..... A61G 5/10
WO WO 8909589 A1 * 10/1989 ..... A45B 11/00

*Primary Examiner* — D Glenn Dayoan
*Assistant Examiner* — Paul Chenevert
(74) *Attorney, Agent, or Firm* — Theresa Stadheim; Krithiga Ganesan

(57) ABSTRACT

A mobility vehicle including a wheeled frame having two front wheels and two rear wheels; a seat disposed at a widthwise center of the mobility vehicle over the front wheels and the two rear wheels; a first mounting member mounted between a first front wheel and a first rear wheel on a first side of the mobility vehicle; a second mounting member mounted between a second front wheel and a second rear wheel on a second side of the mobility vehicle parallel to the first side of the mobility vehicle; and a protection system mounted to the first mounting member and to the second mounting member and providing cover over the seat.

20 Claims, 6 Drawing Sheets

(56) References Cited

U.S. PATENT DOCUMENTS

| | | | | |
|---|---|---|---|---|
| 2015/0296990 | A1* | 10/2015 | Malik | A61G 5/10<br>280/47.38 |
| 2016/0058638 | A1* | 3/2016 | Davis | A61G 5/10<br>297/184.12 |

* cited by examiner

"P.C. BUBBLE" PROTECTIVE BUBBLE FOR MOBILITY VEHICLE

CROSS-REFERENCE TO RELATED APPLICATIONS

This patent application claims the benefit of priority, under 35 U.S.C. § 119(e), to U.S. Provisional Patent Application Ser. No. 62/179,159, entitled "P.C. (POWER CHAIR/SCOOTER) BUBBLE," filed on Apr. 30, 2015, which is herein incorporated by reference in their entirety.

TECHNICAL FIELD

Embodiments relate to wheelchairs, power chairs, or scooters. Specifically, some embodiments relate to covers for fitting onto power chairs, wheelchairs, or scooters, to shield the occupant from outdoor weather elements such as sun, rain, wind, hail, snow, etc.

BACKGROUND

Wheelchairs, power chairs, and other similar vehicles are frequently used to provide mobility for a person who has a limited ability to walk either temporarily or permanently. Operation outdoors creates the need for enhanced shade or shelter.

DETAILED DESCRIPTION

Embodiments provide for a bubble-like covering, attachable and adaptable to electric motorized wheelchairs, power chairs, scooters, etc. to provide protection to the occupant from weather events such as sun, wind, rain, hail, and snow. This bubble-like covering can be referred to as a P.C. Bubble™ available from Crescia Hagler of St. Paul, Minn.

Figure 1A:
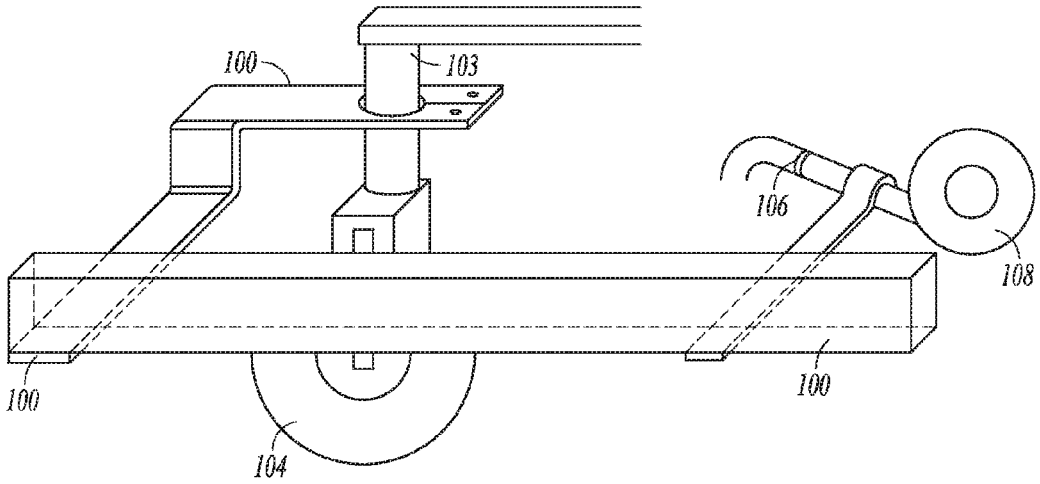
FIG. 1A is a side view of a mounting mechanism for a protective cover in accordance with various embodiments.

FIG. 1A is a side view of a mounting mechanism 100 for a protective cover in accordance with various embodiments. Preformed, rectangular mounting mechanism 100 is approximately 48 inches long, 4 inches deep, and 2 inches wide with longitudinal grooves cut down the center. The groove is about 3 inches deep. Any dimensions described are examples only and not intended to limit the embodiments described herein. For example, dimensions measured herein may apply to some models of power chairs, electric wheelchairs, scooters, etc., while different dimensions will apply to other models.

The mounting mechanism 100 does not touch the ground, and extends out from one side of the power chair 200 (FIG. 2) laterally. As will be appreciated (although not shown in FIG. 1A) another pre-formed and attached protective cover holder will be provided in various embodiments on the other side of a power chair 200.

Figure 1B:
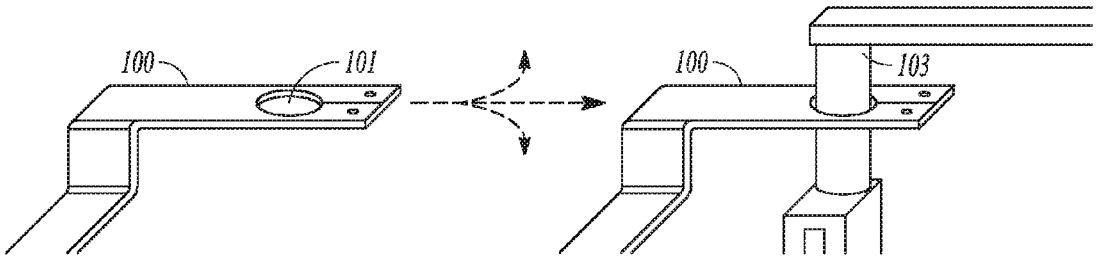
FIG. 1B illustrates a rear coupling mechanism for the mounting mechanism of a protective cover in accordance with various embodiments.
Figure 1C:
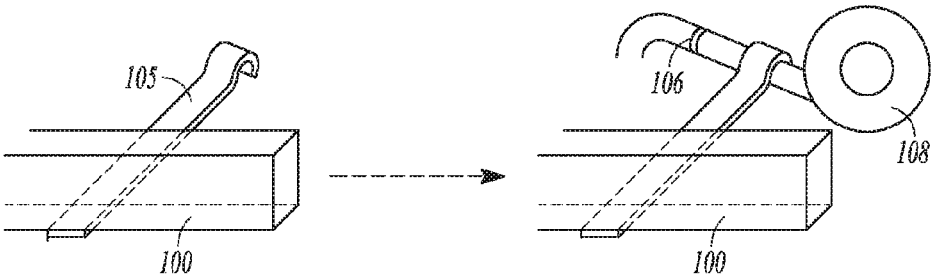
FIG. 1C illustrates a front coupling mechanism for the mounting mechanism of a protective cover in accordance with various embodiments.

FIG. 1B illustrates a rear coupling mechanism for the mounting mechanism 100 of a protective cover in accordance with various embodiments. As shown in FIG. 1B, the mounting mechanism 100 includes a rear wheel bracket with a flexible opening 101 that can be attached around tubular portions 103 of the rear wheel 104 mechanism. FIG. 1C illustrates a front coupling mechanism for the mounting mechanism 100 of a protective cover in accordance with various embodiments. As shown in FIG. 1C, the mounting mechanism 100 also attaches using member 105 at the front of the power chair at front extensions 106, which may include or be part of anti-tip wheels 108.

Figure 1D:
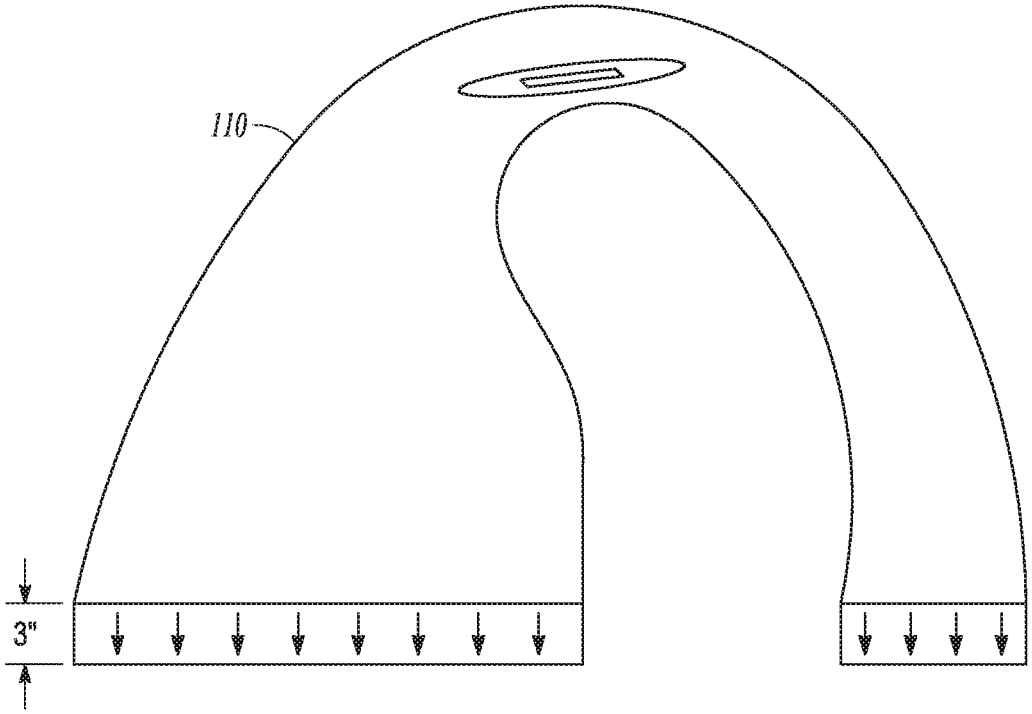
FIG. 1D is a side view of a protective cover in accordance with various embodiments.

FIG. 1D is a side view of a protective cover 110 in accordance with various embodiments. As shown in FIG. 1D, the protective cover 110 can be a pre-formed, single unit of lightweight, clear, scratch proof, waterproof, UV-protected industrial plastic that is mounted over a power chair 200 as depicted later herein, or at least somewhat similarly to that depicted, after the plastic mounting mechanism 100 have been securely attached to the power chair as shown in FIGS. 1B and 1C and inserted down inside the pre-cut longitudinal grooves of the plastic mounting mechanism 100, on each side of the power chair 200.

Figure 2:
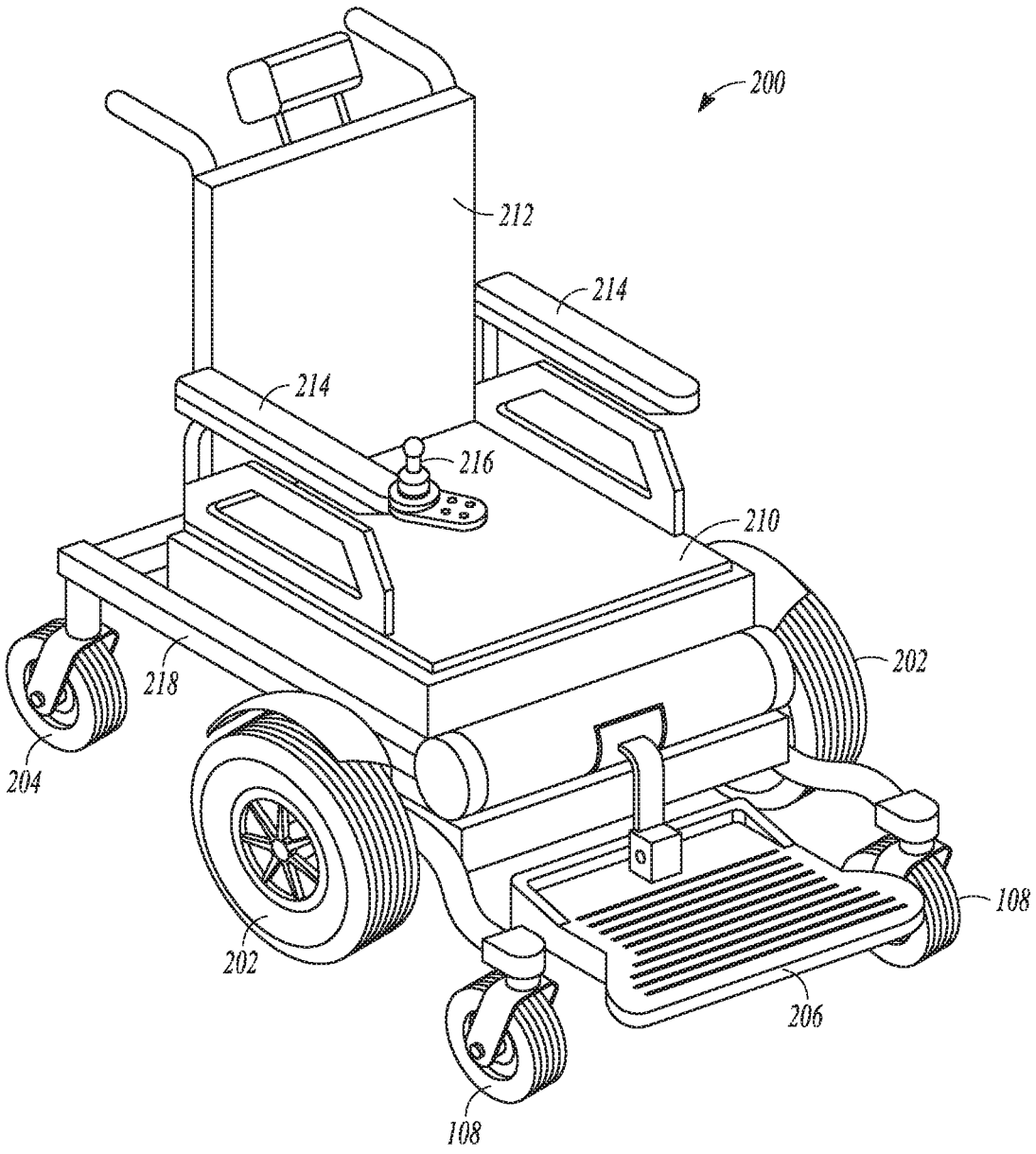
FIG. 2 is a perspective view of a power chair in accordance with some embodiments.

FIG. 2 is a front view of a power chair 200 in accordance with some embodiments. The power chair 200 includes a pair of right and left front wheels 202 and a pair of right and left rear wheels 204 and is thus four-wheeled, although some embodiments can include anti-tip wheels 108. Some or all wheels may be caster wheels. The front wheels 202 are steered wheels while the rear wheels 204 are driving wheels. The front wheels 202 can have a diameter larger than that of the rear wheels 204 although embodiments are not limited thereto.

Flat floor 206 for resting the feet of a driver is provided between the front wheels 202. The seat 210 is disposed at a widthwise center between and above the wheels 204, 202. A backrest 212 rising from a rear part of the seat 210 for supporting the back of the driver. The power chair 200 can include armrests 214 and a steering mechanism 216. A frame 218 provides support and interconnection between the front wheels 202 and the rear wheels 204. Anti-tip wheels 108 can also be provided.

Thousands of individuals depend daily upon motorized electric wheel and/or power chairs, such as the power chair 200 shown in FIG. 2, to transport themselves outside their homes to conduct normal personal affairs such as working, shopping, appointments, recreation, etc. Use of power chairs 200 enable individuals to live independent lifestyles. However, some motorized power chairs 200 do not currently provide protection from a variety of adverse weather events.

The embodiments described above provide cover and protection for individuals whose daily mobility depends on the use of a vehicle such as the power chair 200. Some available covers do not provide sufficient protection, durability, or visibility. Embodiments address these and other concerns through use of a translucent or transparent, durable, preferably hard plastic cover (e.g., a "bubble") that can be easily detached from the power chair 200 for added convenience for the user or for caregivers.

Figure 3:
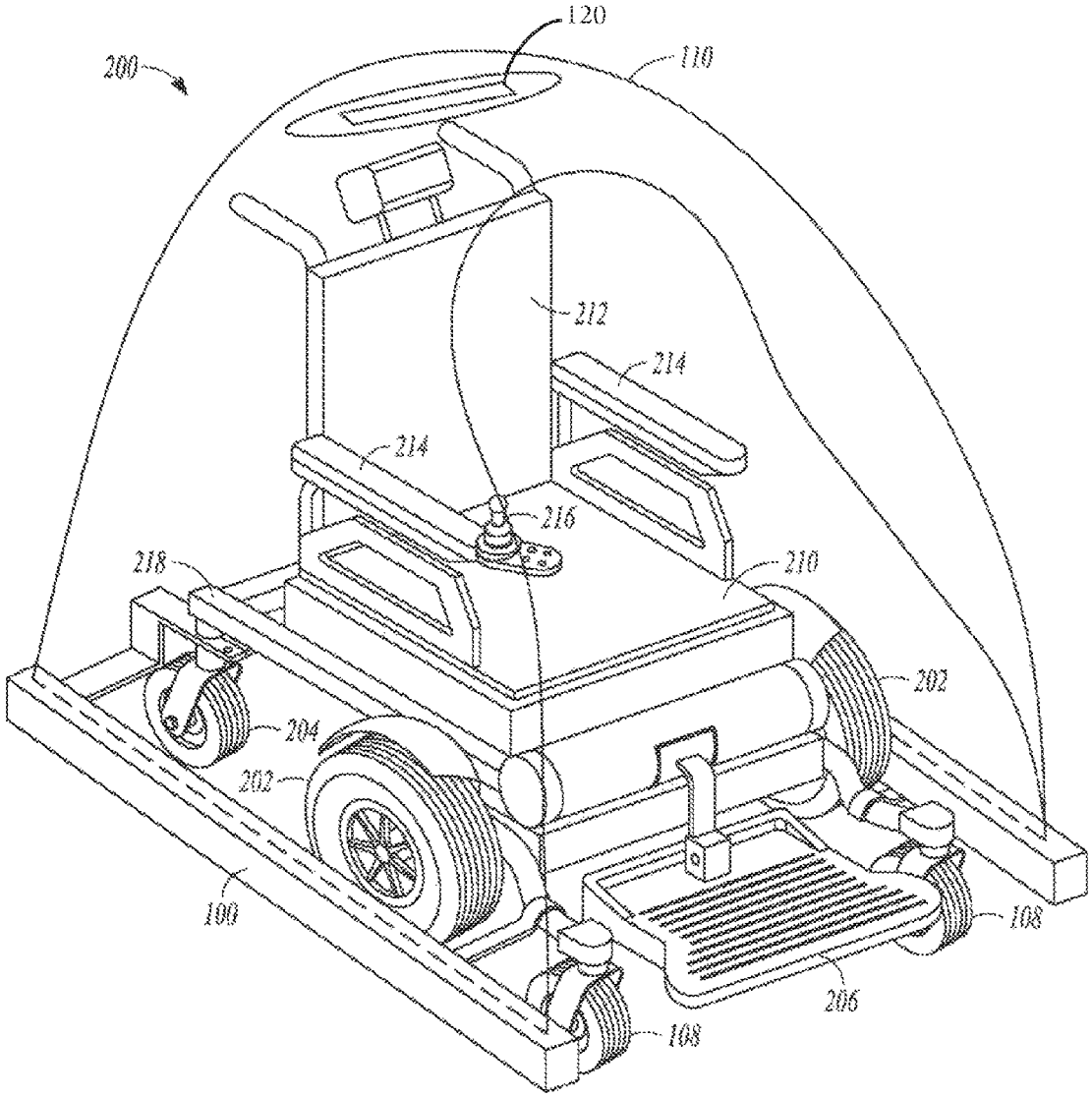
FIG. 3 is a perspective view of a power chair having a protective cover attached in accordance with various embodiments.

FIG. 3 is a perspective view of a power chair 200 having a protective cover 110 attached/detached in accordance with various embodiments using mechanisms described above with respect to FIGS. 1A-1D. In alternative embodiments, the mounting mechanism 100 can be arranged in a circular or semicircular fashion around the power chair 200. In some embodiments, the protective cover 110 may comprise two or more pieces to fit over separate halves of the power chair 200. In some embodiments, separate, heavy duty, metal connectors can securely snap over anti-tip wheels 108, and additional heavy-duty metal connectors can extend underneath the power chair 200 to provide further stability. Additional connectors could extend vertically, for example from a middle portion of the mounting mechanism 100, to secure to an armrest or other upper portion of the power chair 200 for additional stability. Also shown in FIG. 3 is a pouch 120 provided on top of the protective cover 110. In one example, the pouch 120 can be attachable to the protective cover 110 by a Velcro closure strip. The pouch 120 can house a clear, sturdy, re-foldable plastic sheet that can be easily accessed and pulled out and down in the front by the occupant to completely cover the front opening of the protective cover 110.

Figure 4:
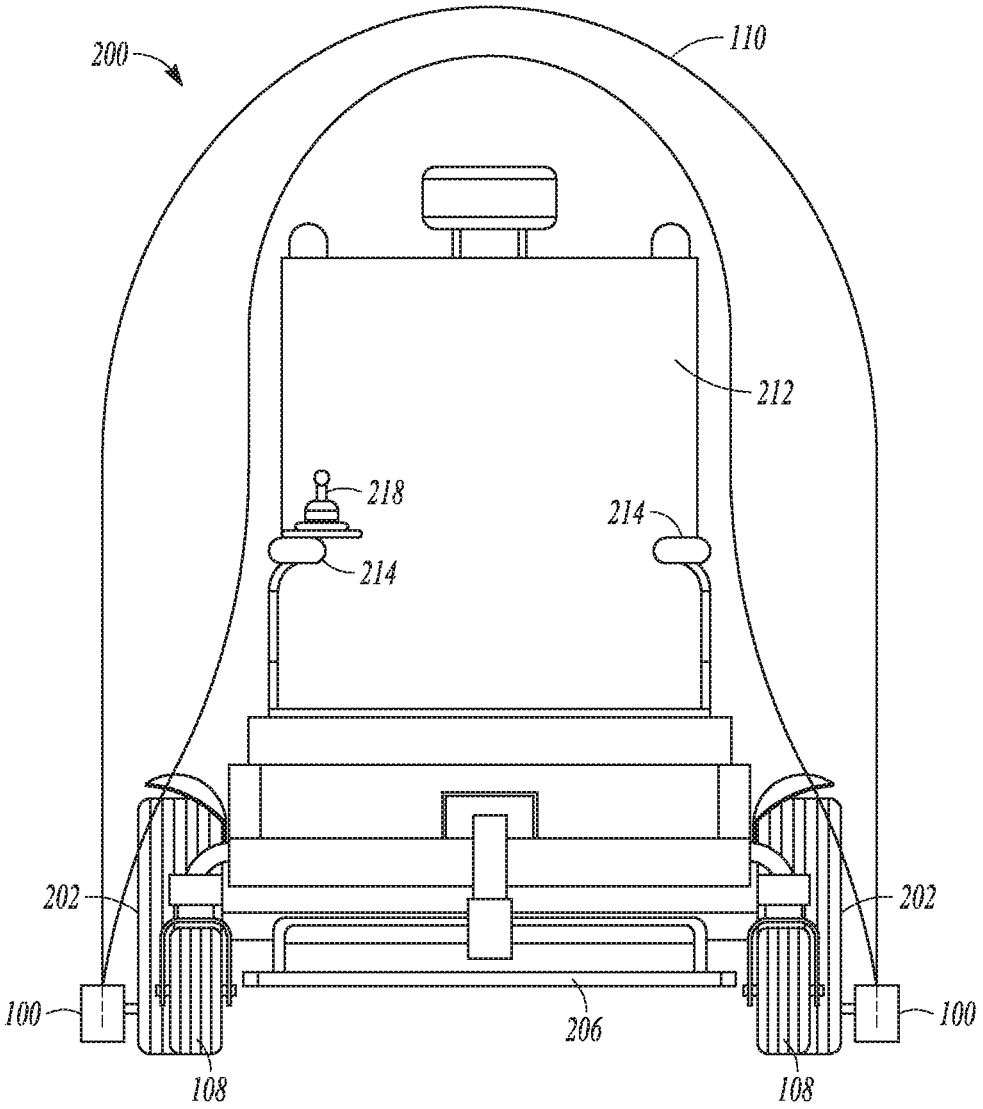
FIG. 4 is a front view of a power chair having a protective cover attached in accordance with various embodiments.

FIG. 4 is a front view of the power chair 200 having a protective cover 110 attached according to various embodiments. As depicted, a mounting mechanism 100 is attached on either side of the power chair 200.

Figure 5:
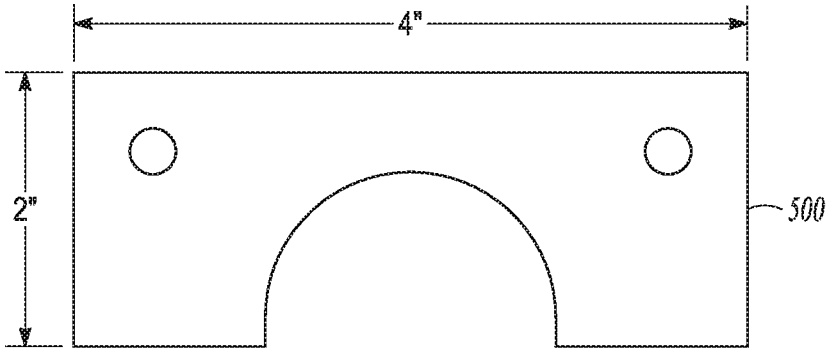
FIG. 5 illustrates a rear-wheel fastener for attaching a protective cover in accordance with various embodiments.

FIG. 5 illustrates a rear-wheel fastener 500 for attaching a protective cover in accordance with various embodiments. The rear wheel fastener 500 can be four inches long and 2 inches high, although embodiments are not limited thereto. The rear wheel fastener 500 can connect to a rear wheel 104 of the power chair 200.

The above Detailed Description is intended to be illustrative, and not restrictive. For example, the above-described examples (or one or more elements thereof) can be used in combination with each other. Other embodiments can be used, such as by one of ordinary skill in the art upon reviewing the above description. Also, various features or elements can be grouped together to streamline the disclosure. This should not be interpreted as intending that an unclaimed disclosed feature is essential to any claim. Rather, inventive subject matter can lie in less than all features of a particular disclosed embodiment. Thus, the following claims are hereby incorporated into the Detailed Description, with each claim standing on its own as a separate embodiment. The scope of the invention should be determined with reference to the appended claims, along with the full scope of equivalents to which such claims are entitled.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The Abstract is provided to comply with 37 C.F.R. § 1.72(b), to allow the reader to quickly ascertain the nature of the technical disclosure. It is submitted with the understanding that it will not be used to interpret or limit the scope or meaning of the claims.

Although the invention has been described with reference to exemplary embodiments, workers skilled in the art will recognize that changes may be made in form and detail without departing from the spirit and scope of the invention.

What is claimed is:

1. A mobility vehicle, comprising:

a frame having a first frame member, a second frame member, a third frame member and a fourth frame member;

a first front wheel, a second front wheel and a first rear wheel and a second rear wheel, the first front wheel and the first rear wheel being positioned on a first lateral side, and the second front wheel and the second rear wheel being positioned on a second lateral side opposite to the first lateral side;

a seat disposed at a widthwise center of the mobility vehicle over the front wheels and the two rear wheels;

a mounting mechanism including a first mounting member extending along the first lateral side, the first mounting member having a first end, a second end opposite to the first end and a first connecting portion extending between the first end and the second end, the first connecting portion of the first mounting member being connected to the first frame member near the first front wheel and the second end of the first mounting member being connected to the second frame member near the first rear wheel;

a second mounting member extending along the second lateral side, the second mounting member having a first end, a second end, and a second connecting portion extending between the first end and the second end, the second connecting portion of the second mounting member being connected to the third frame member near the second front wheel and the second end of the second mounting member being connected to the fourth frame member near the second rear wheel; and a protection system connected to the first mounting member and to the second mounting member and providing cover over the seat.

2. The mobility vehicle of claim 1, wherein the mobility vehicle is a power chair.

3. The mobility vehicle of claim 1, wherein the first mounting member and the second mounting member are comprised of plastic.

4. The mobility vehicle of claim 1, wherein the first mounting member and the second mounting member are comprised of metal.

5. The mobility vehicle of claim 1 wherein the protection system comprises waterproof and UV-protected materials.

6. The mobility vehicle of claim 1, further comprising a pair of arm rests disposed on either side of the seat, and wherein the entirety of the mounting mechanism is positioned below a plane containing the pair of arm rests.

7. The mobility vehicle of claim 1 wherein the protection system is open at a front viewing window at a front portion of the mobility vehicle for allowing a viewing area to the outside through the protection system.

8. The mobility vehicle of claim 7, further comprising a pouch attachable to a top portion of the protection system.

9. The mobility vehicle of claim 8, wherein the pouch is configured to house a re-foldable plastic sheet therewithin, the re-foldable plastic sheet being removable from the pouch so as to cover the front viewing window.

10. A protection system, connectable to a mobility vehicle, the mobility vehicle comprising a frame supported by at least one front wheel, and two rear wheels, and a seat disposed between the at least one front wheel and the two rear wheel, the protection system comprising:

a first mounting member having a first end, a second end opposite to the first end, and a first connection portion extending between the first end and the second end;

a second mounting member having a first end, a second end opposite to the first end and a second connecting portion extending between the first end and the second end;

a first connection member having a first end and a second end, the first end of the first connection member being attachable to the first connection portion, and a second end of the first connection member being connectable to a first portion of the frame near the at least one front wheel;

a second connection member having a first end and a second end, the first end of the second connection member being attachable to the second end of the first mounting member, and the second end of the second connection member being connectable to a second portion of the frame near one of the rear wheels;

a third connection member having a first end and a second end, the first end of the third connection member being connectable to the second connection portion, and the second end of the third connection member being connectable to a third portion of the frame near the at least one front wheel;

a fourth connection member having a first end and a second end, the first end of the fourth connection member being connectable to the second end of the second mounting member, and the second end of the fourth connection member being connectable to a fourth portion of the frame near another one of the rear wheels such that when connected, the first mounting member and the second mounting member are disposed generally parallel to a direction of travel of the mobility vehicle when the mobility vehicle is moving; and a protective cover having a first portion connectable to the first mounting member, a second portion connectable to the second mounting member, and a cover portion extending between the first portion and the second portion, the cover portion configured to provide protective cover over the seat of the mobility vehicle when connected to the first bracket and the second bracket.

11. The protection system of claim 10, wherein the first bracket and the second bracket are comprised of plastic.

12. The protection system of claim 10, wherein the first bracket and the second bracket are comprised of metal.

13. The protection system of claim 10, wherein:

the second connection member and the fourth connection member each having an opening at their respective second end, the opening of the second connection member being configured to surround a tubular portion of the second portion of the frame, the opening of the fourth connection member being configured to surround a tubular portion of the fourth portion of the frame.

14. The protection system of claim 10, wherein:

the second end of each of the first connection member and the second connection member has a curved portion at their respective second ends, the curved portion of the first connection member being engageable with a tubular portion of the first portion of the frame, and the curved portion of the third connection member being engageable with a tubular portion of the third portion of the frame.

15. The protection system of claim 10, wherein the protection system is comprised of plastic.

16. The protection system of claim 15, wherein the protection system is waterproof.

17. The protection system of claim 15, wherein the protection system is transparent.

18. The protection system of claim 15, wherein the protection system is arranged to provide 360-degree visibility.

19. The protection system of claim 15, wherein the protection system is constructed of UV-protected plastic.

20. The protection system of claim 15, wherein the protection system is scratch-resistant.

* * * * *